US009450355B2

(12) United States Patent
Zhang

(10) Patent No.: US 9,450,355 B2
(45) Date of Patent: Sep. 20, 2016

(54) USB PLUG CONNECTOR AND METHOD FOR MANUFACTURING THE SAME

(71) Applicant: FOXCONN INTERCONNECT TECHNOLOGY LIMITED, Grand Cayman (KY)

(72) Inventor: Wei-De Zhang, Shenzhen (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/656,051

(22) Filed: Mar. 12, 2015

(65) Prior Publication Data

US 2015/0263465 A1 Sep. 17, 2015

(30) Foreign Application Priority Data

Mar. 12, 2014 (CN) ..... 2014 1 0088590

(51) Int. Cl.
*H01R 24/60* (2011.01)
*H01R 13/6581* (2011.01)
*H01R 107/00* (2006.01)

(52) U.S. Cl.
CPC ..... *H01R 24/60* (2013.01); *H01R 13/6581* (2013.01); *H01R 2107/00* (2013.01); *Y10T 29/49218* (2015.01)

(58) Field of Classification Search
CPC ..... H01R 24/60; H01R 13/6581; H01R 2107/00
USPC ..... 439/660, 676, 607.01, 607.22, 607.23, 439/607.24, 607.26, 607.2, 607.21, 607.33, 439/607.43, 607.53, 607.55, 607.54, 620.1, 439/620.13, 620.15, 620.19, 626, 638
See application file for complete search history.

(56) References Cited

U.S. PATENT DOCUMENTS

| | | | | |
|---|---|---|---|---|
| 6,152,773 | A * | 11/2000 | Chen | H01R 23/6873 439/607.01 |
| 7,682,199 | B2 | 3/2010 | Ahn et al. | |
| 8,137,131 | B2 * | 3/2012 | Wang | H01R 12/707 439/570 |
| 8,461,465 | B2 | 6/2013 | Golko et al. | |
| 8,794,981 | B1 | 8/2014 | Rodriguez et al. | |
| 2007/0042621 | A1 * | 2/2007 | Chen | H01R 13/6595 439/157 |
| 2007/0243764 | A1 * | 10/2007 | Liu | H01R 13/6581 439/607.01 |
| 2009/0142964 | A1 * | 6/2009 | Wang | H01R 13/41 439/638 |

(Continued)

FOREIGN PATENT DOCUMENTS

| | | |
|---|---|---|
| CN | 203193000 | 9/2013 |
| TW | M253969 | 12/2004 |

*Primary Examiner* — Abdullah Riyami
*Assistant Examiner* — Harshad Patel
(74) *Attorney, Agent, or Firm* — Ming Chieh Chang; Wei Te Chung

(57) ABSTRACT

A USB plug connector (100) includes an insulative housing (1) having a main portion (11) and a tongue portion (12), a number of contacts (2), and a metal shell (3). The tongue portion has an upper surface (16), a lower surface (17), a pair of lateral surfaces (18), and a frontal vertical surface (121). A pair of recesses (122) is defined on both sides of the upper surface and the lower surface. An interspace (181) is defined between each lateral surface of the tongue portion and the main portion. The metal shell includes a front wall (31), a pair of horizontal walls (32), and a pair of vertical walls (34). Each vertical wall includes a rigid beam (342) inserted in the interspace and a pair of wing portions (343) received in the recesses. A method for manufacturing the USB plug connector is also disclosed.

15 Claims, 7 Drawing Sheets

(56) References Cited

U.S. PATENT DOCUMENTS

2010/0255710 A1* 10/2010 Lin ..... H01R 23/6873 439/374
2012/0156935 A1* 6/2012 Peng ..... H01R 13/6581 439/626
2012/0282811 A1* 11/2012 Lin ..... H01R 43/20 439/626
2013/0117470 A1 5/2013 Terlizzi et al.
2013/0237093 A1* 9/2013 Kamarauskas .... H01R 13/2442 439/607.58

* cited by examiner

USB PLUG CONNECTOR AND METHOD FOR MANUFACTURING THE SAME

CROSS-REFERENCE TO RELATED APPLICATIONS

This patent application relates to a pending U.S. patent application entitled "USB PLUG CONNECTOR AND METHOD FOR MANUFACTURING THE SAME," which is published as US 2014/0213110 on 2014 Jul. 31 and assigned to the same assignee as this application.

BACKGROUND OF THE INVENTION

1. Field of the Invention

The present invention relates generally to a USB (Universal Serial Bus) plug connector, and more particularly to a method for manufacturing the USB plug connector.

2. Description of Related Arts

Taiwan Pat. No. M253969 issued on 2004 Dec. 21 discloses an electrical connector assembly comprising a plug connector and a receptacle connector. The plug connector is normally and reversely inserted into the receptacle connector. The receptacle connector comprises an insulative body, and a plurality of upper contacts retained in an upper face of the insulative body, and a plurality of lower contacts retained in a lower face of the insulative housing. The plug connector has a tongue portion and a plurality of plug contacts retained in the tongue portion. The receptacle connector is received in a case portion. An upper space of the case portion above the mating tongue of the receptacle connector receives the so called normally inserted plug connector when the plug contacts engage with the upper contacts of the receptacle connector. A lower space of the case portion below the mating tongue of the receptacle connector receives the so-called called reversely inserted plug connector when the plug contacts engage with the lower contacts of the receptacle connector.

China Patent Pub. No. 203193000 published on 2013 Sep. 11 discloses a plug connector comprising an insulative housing, a plurality of contacts retained in the insulative housing, a metal shield covering the insulative housing, a printed circuit board connected with the contacts, an insulative cover partly molded over the metal shield, and a cable soldered with the printed circuit board for electrical connection with the contacts. The metal shield comprises a frontal vertical wall and a pair of guiding walls extending laterally from two ends of the frontal vertical walls. The insulative housing forms a pair of sidewalls moveably received in the guiding walls along a front-and-rear direction in a manufacturing method of the plug connector.

A USB plug connector and its method of manufacturing are desired.

SUMMARY OF THE INVENTION

Accordingly, an object of the present invention is to provide a USB plug connector and a method for manufacturing the USB plug connector.

To achieve the above object, a USB plug connector includes an insulative housing, a plurality of contacts retained in the insulative housing, and a metal shell assembled on the insulative housing. The insulative housing has a main portion and a tongue portion extending forwardly from the main portion. The tongue portion has an upper surface, a lower surface, a pair of lateral surfaces, and a frontal vertical surface. A pair of recesses is defined on both sides of each of the upper surface and the lower surface. An interspace is defined between each lateral surface of the tongue portion and the main portion. The metal shell includes a front wall, a pair of horizontal walls bent backwardly from upper and lower edges of the front wall, and a pair of vertical walls bent backwardly from left and right ends of the front wall. Each vertical wall includes a base portion, a rigid beam extending backwardly from the base portion and inserted in the interspace of the insulative housing, and a pair of wing portions bent horizontally from upper and lower edges of the base portion and received in the recesses of the tongue portion.

To achieve the above object, a method for manufacturing the USB plug connector includes steps of: providing a plurality of contacts and insert-molding an insulative housing which retains the contacts, wherein the insulative housing comprises a main portion and a tongue portion extending forwardly from the main portion, the tongue portion having an upper surface, a lower surface, a pair of lateral surfaces, and a frontal vertical surface, a pair of recesses is defined on both sides of each of the upper surface and the lower surface, and an interspace is defined between each lateral surface of the tongue portion and the main portion;

stamping a metal piece to form a substantially cross shaped, unfolded metal shell having a front wall, a pair of horizontal walls, and a pair of vertical walls, the front wall and the horizontal walls cooperatively defining a first straight line, the vertical walls and the front wall cooperatively defining a second straight line perpendicular to the first straight line, each vertical wall having a base portion, a rigid beam extending from the base portion, and a pair of wing portions extending vertically and oppositely from upper and lower edges of the base portion;

bending the vertical walls from the left and right ends of the front wall along a front-and-rear direction and inserting the rigid beams in the interspaces of the insulative housing to initially retain the metal shell on the insulative housing; bending the wing portions from the base portion along a left-and-right direction perpendicular to the front-and-rear direction and inserting the wing portions in the recesses of the tongue portion; and bending the top wall and the bottom wall from the upper and lower edges of the front wall along the front-and-rear direction and securing the top wall and the bottom wall on the main portion of the insulative housing to finally assemble the metal shell on the insulative housing.

Other objects, advantages and novel features of the invention will become more apparent from the following detailed description when taken in conjunction with the accompanying drawings.

DETAILED DESCRIPTION OF THE PREFERRED EMBODIMENT

Figure 1:
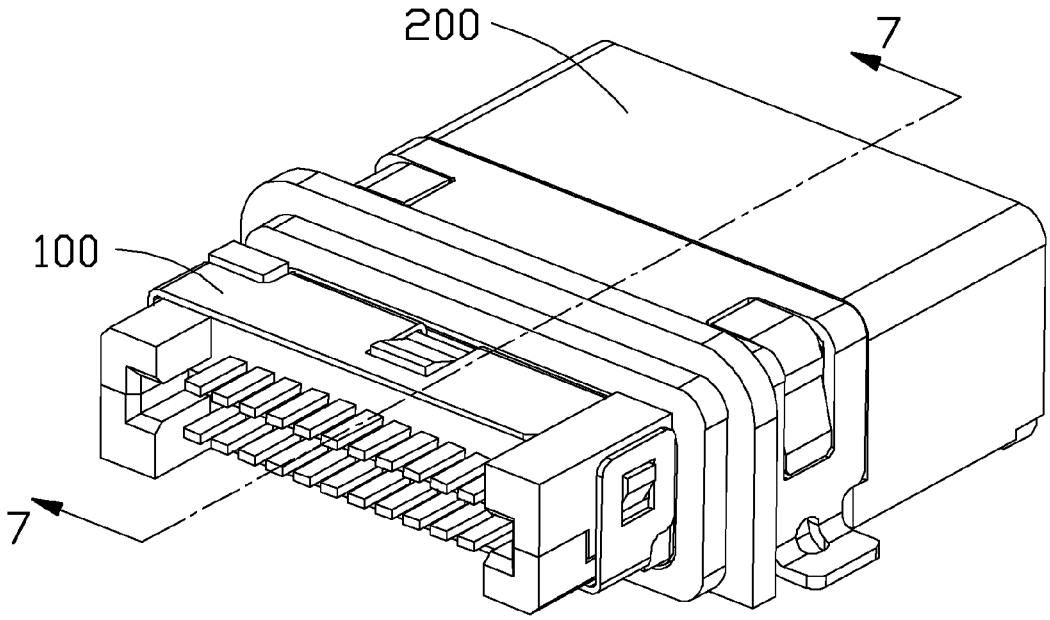
FIG. 1 is a perspective, assembled view of a plug connector constructed in accordance with the present invention when the plug connector is engaged with a receptacle connector.
Figure 2:
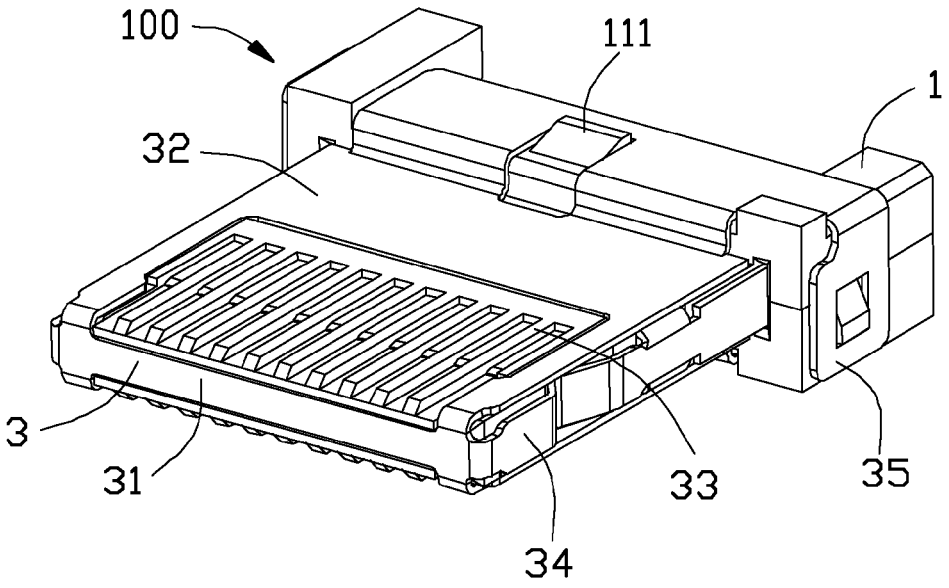
FIG. 2 is a perspective, assembled view of the plug connector of FIG. 1.
Figure 3:
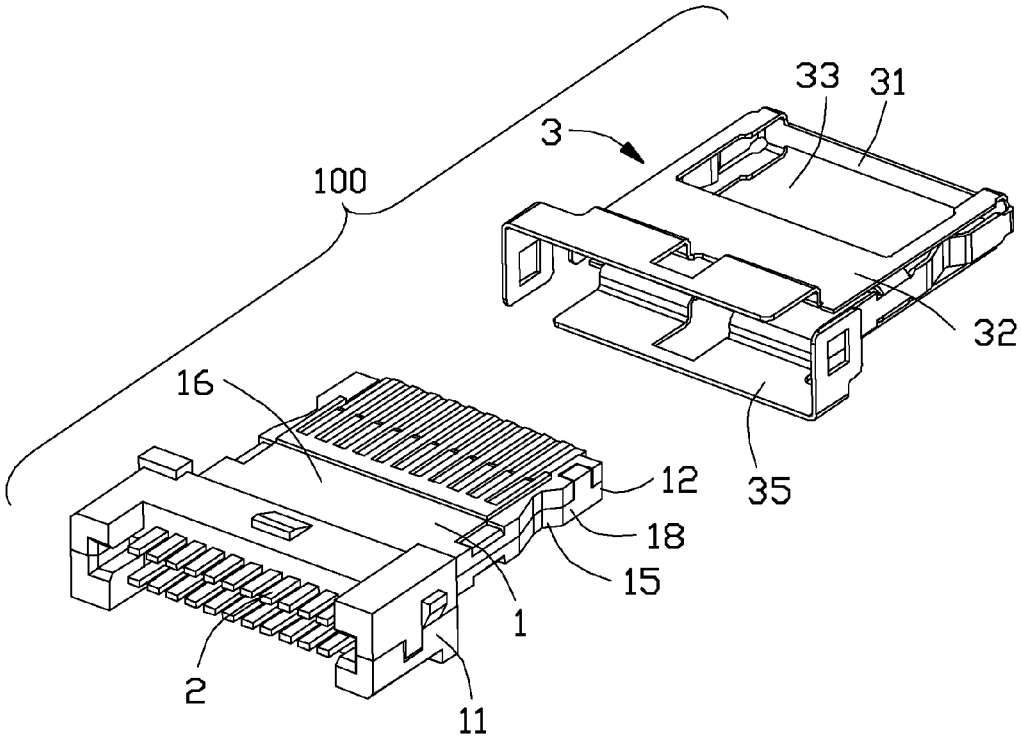
FIG. 3 is a perspective, partly exploded view of the electrical connector of FIG. 2.
Figure 4:
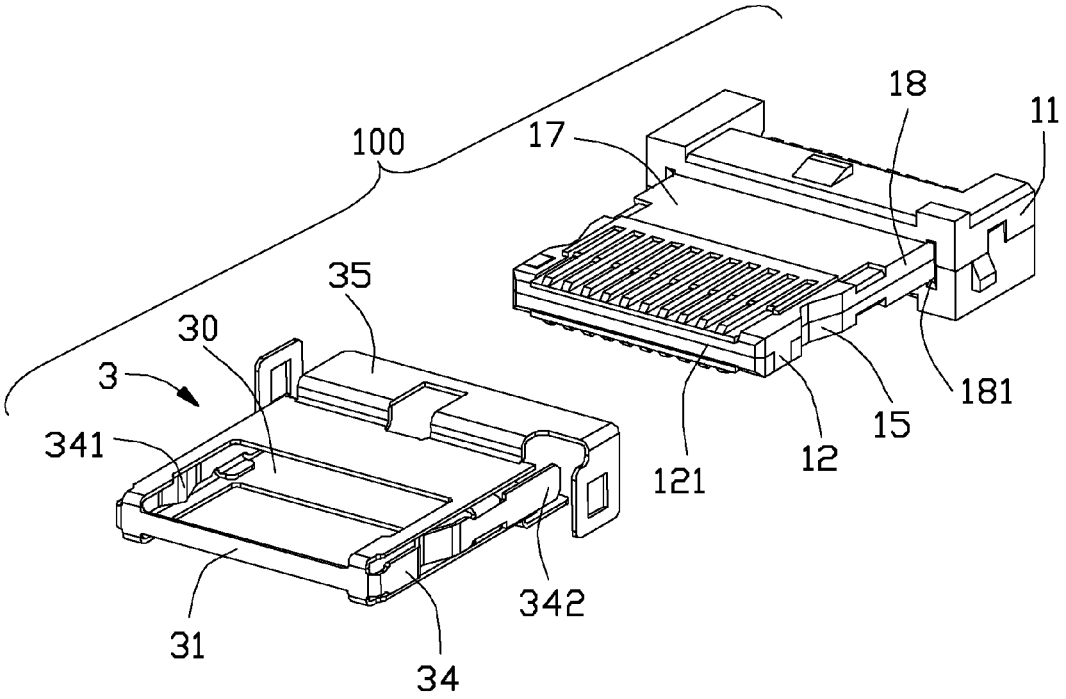
FIG. 4 is similar to FIG. 3, but taken from a different view.
Figure 5:
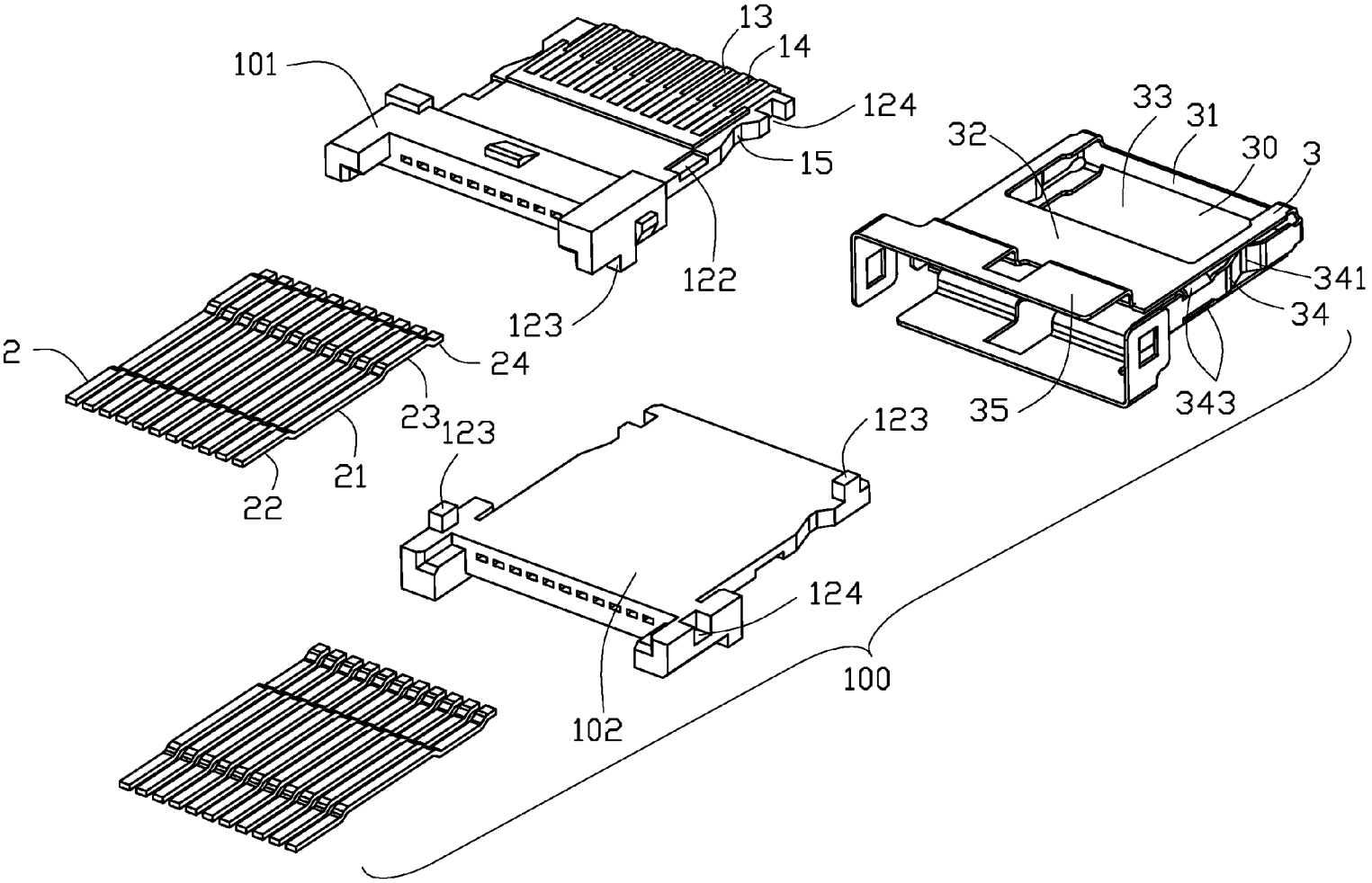
FIG. 5 is a perspective, fully exploded view of the electrical connector of FIG. 2.

Reference will now be made in detail to the preferred embodiment of the present invention.

Referring to FIGS. 1-7, a USB (Universal Serial Bus) plug connector 100 of the present invention, used for engaging with a USB receptacle connector 200, comprises an insulative housing 1, a plurality of contacts 2 retained in the insulative housing 1, and a metal shell 3 covering the insulative housing 1.

Referring to FIGS. 3-6, the insulative housing 1 is a combination of an upper insulative plate 101 and a lower insulative plate 102. The upper insulative plate 101 and the lower insulative plate 102 are substantially identical in structure. Each of the upper insulative plate 101 and the lower insulative plate 102 comprises a plurality of blocks 123 and a plurality of notches 124. The blocks 123 of the upper insulative plate 101 are retained in the notches 124 of the lower insulative plate 102 and the notches 124 of the upper insulative plate 101 receive the upper insulative plate 101 of the lower insulative plate 102 for orientation between the upper insulative plate 101 and the lower insulative plate 102.

Referring to FIGS. 3-6, the insulative housing 1 has a main portion 11 and a tongue portion 12 extending forwardly from the main portion 11. The main portion 11 forms a plurality of protrusions 111 respectively at the upper face, a lower face, and a pair of lateral faces thereof. The tongue portion 12 has an upper surface 16, a lower surface 17, and a pair of lateral surfaces 18, and a frontal vertical surface 121 connecting between and terminating the upper surface 16, the lower surface 17, and the lateral surfaces 18. The insulative housing 1 defines a pair of recesses 122 on both the upper surface 16 and the lower surface 17. The recesses 122 abut the adjacent lateral surfaces 18. The insulative housing 1 forms a plurality of ribs 13 and defines a plurality of passageways 14 between each two adjacent ribs 13 on both the upper surface 16 and the lower surface 17. The insulative housing 1 has a dent 15 at each lateral surface 18. Each passageway 14 defines a front inner slit 141, a back inner slit 142, and an opening 143 connecting between the front inner slit 141 and the back inner slit 142. The opening 143 is communicated with outside for exposing the contacts 2. The insulative housing 1 defines an interspace 181 between each lateral surface 18 of the tongue portion 12 and the main portion 11.

Figure 6:
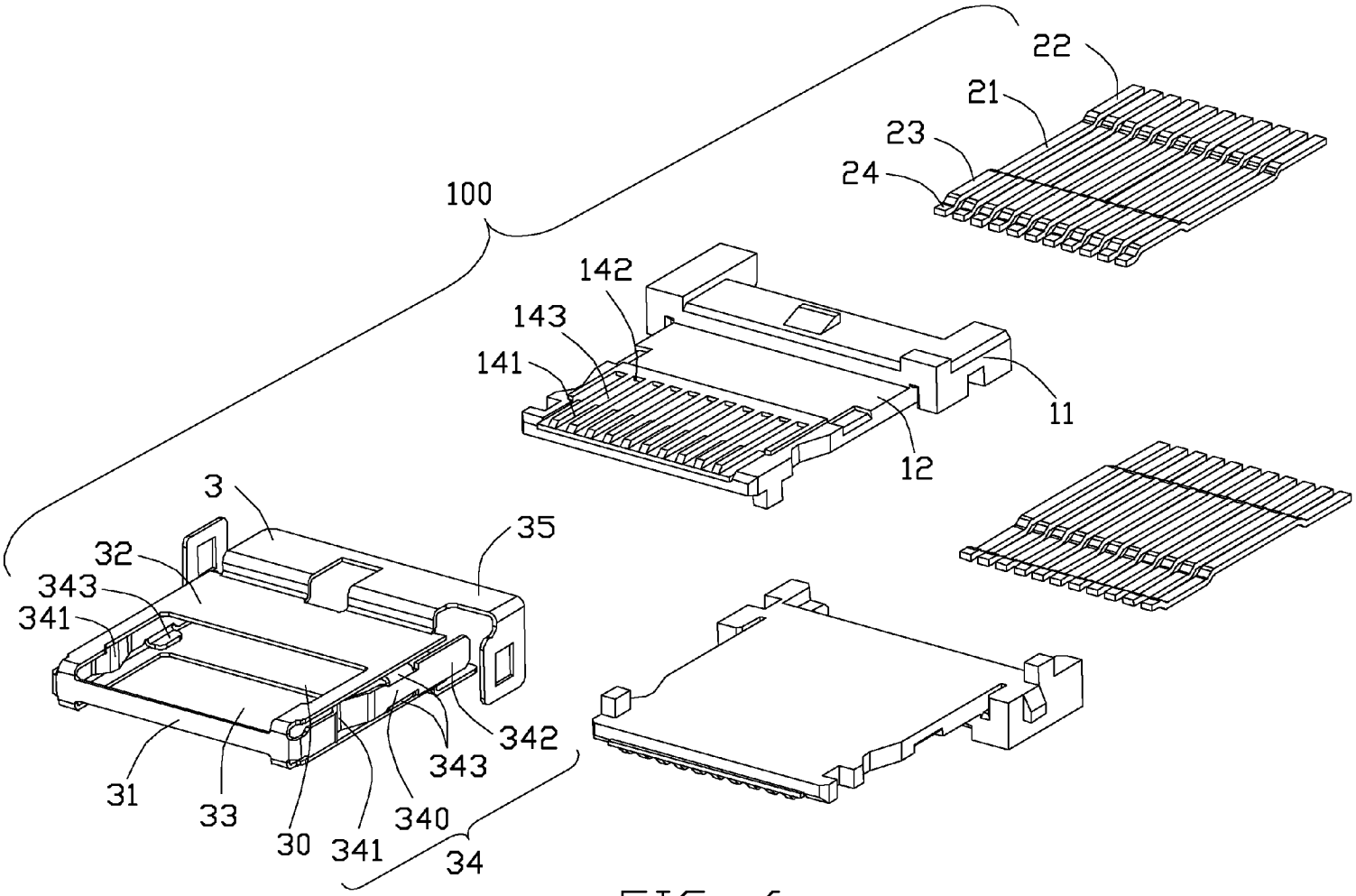
FIG. 6 is similar to FIG. 5, but taken from a different view.
Figure 7:
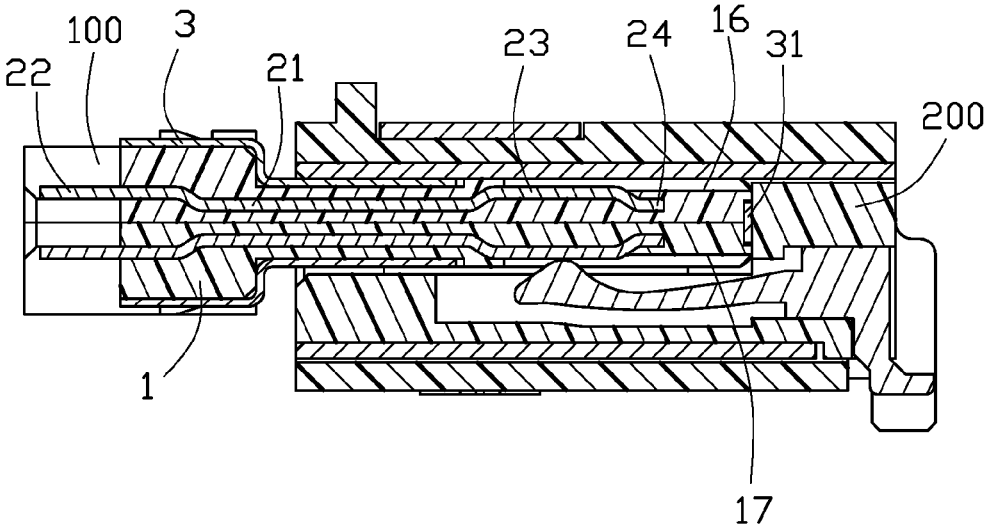
FIG. 7 is a cross-sectional view of FIG. 1 when taken along line 7-7.

Referring to FIGS. 6 and 7, each contact 2 comprises a retaining portion 21, a soldering portion 22 extending backwardly from the retaining portion 21, a contacting portion 23 extending forwardly from the retaining portion 21, and a frontal ending portion 24 extending forwardly from the contacting portion 23. The retaining portion 21 is retained in the back inner slit 142. The frontal ending portion 24 is retained in the front inner slit 141. The contacting portion 23 protrudes higher than the retaining portion 21 and the frontal ending portion 24 to be exposed in the opening 143.

Referring to FIGS. 2-7, the metal shell 3 comprises a front wall 31 extending in both an upper-and-lower direction and a left-and-right direction, a pair of horizontal walls 32 bending backwardly from the upper and lower edges of the front wall 31 along a front-and-rear direction perpendicular to both the upper-and-lower direction and the left-and-right direction, and a pair of vertical walls 34 bending backwardly from the left and right ends of the front wall 31 along the front-and-rear direction for cooperatively defining a receiving space 30. Each horizontal wall 32 defines a cutout 33 suspending above the openings 143, which is adjacent to the front wall 31. Therefore, the contacting portions 23 of the contacts 2 are exposed into the cutouts 33 via the openings 143 for engagement after the contacts 2 are retained in the insulative housing 1, and then the metal shell 3 is assembled on the insulative housing 1. Each vertical wall 34 comprises a base portion 340, a curved portion 341 protruding forwardly from the base portion 340 and inwardly towards the receiving space 30, a rigid beam 342 extending backwardly from the base portion 340, and a pair of wing portions 343 bending horizontally from the upper and lower edges of the base portion 340. When the metal shell 3 is assembled on the insulative housing 1, the curved portions 341 are received in the dents 15 for engagement with the receptacle connector 200, the rigid beams 342 are correspondingly inserted in the interspaces 181 of the insulative housing 1 for initially retaining the metal shell 3 on the insulative housing 1 along the front-and-rear direction, and the wing portions 343 are correspondingly received in the recesses 122 of the tongue portion 12 for further retaining the metal shell 3 on the insulative housing 1 along the upper-and-lower direction. The metal shell 3 further comprises a pair of frame portions 35 extending backwardly from the horizontal walls 32 for finally securing with the main portion 11 of the insulative housing 1.

The metal shell 3 is stamped from a metal piece. The front wall 31, the horizontal walls 32, and the vertical walls 34 are shaped as a cross when the metal shell 3 is unfolded. In another saying, the front wall 31 and the horizontal walls 32 cooperatively define a first straight line while the vertical walls 34 and the front wall 31 cooperatively define a second straight line perpendicular to the first straight line.

A method for manufacturing the USB plug connector 100 comprises steps of:

Step 1: Providing a plurality of contacts 2 and insert-molding an insulative housing 1 which retains the contacts 2, wherein the insulative housing 1 comprises a main portion 11 and a tongue portion 12 extending forwardly from the main portion 11, the tongue portion 12 having an upper surface 16, a lower surface 17, and a pair of lateral surfaces 18, and a frontal vertical surface 121 connecting between the upper surface 16, the lower surface 17, and the lateral surfaces 18, a pair of recesses 122 is defined on both sides of the upper surface 16 and the lower surface 17, and an interspace 181 is defined between each lateral surface 18 of the tongue portion 12 and the main portion 11;

step 2: Stamping a metal piece to form a substantially cross shaped, unfolded metal shell 3 having a front wall 31 and a pair of horizontal walls 32 cooperatively defining a first straight line and a pair of vertical walls 34 and the front wall 31 cooperatively defining a second straight line perpendicular to the first straight line, each vertical wall 34 having a base portion 340, a rigid beam 342 extending from the base portion 340, and a pair of wing portions 343 extending vertically and oppositely from upper and lower edges of the base portion 340;

step 3: Bending the vertical walls 34 from the left and right ends of the front wall 31 along a front-and-rear direction and inserting the rigid beams 342 in the interspaces 181 of the insulative housing 1 for initially retaining the metal shell 3 on the insulative housing 1;

step 4: Bending the wing portions 343 from the base portion 340 along a left-and-right direction perpendicular to the front-and-rear direction for being received in the recesses 122 of the tongue portion 12; and step 5: Bending the top wall 31 and the bottom wall 32 from the upper and lower edges of the front wall 31 along the same front-and-rear direction and securing the top wall 31 and the bottom wall 32 on the main portion 11 of the insulative housing 1 for finally assembling the metal shell 3 on the insulative housing 1.

The front wall 31, the horizontal walls 32, and the vertical walls 34 of the metal shell 3 respectively cover the frontal vertical surface 121, the upper and lower surfaces 16, 17, and the lateral surfaces 18 of the insulative housing 1 for reinforcing the tongue portion 12 of the insulative housing 1. The front wall 31 of the metal shell 3 has a height in the upper and lower direction smaller than that of the tongue portion 12, the receptacle connector 200 is prevented from connecting with the front wall 31, and therefore, shorting is prevented when the plug connector 100 is engaged with the receptacle connector 200. The wing portions 343 are sandwiched between the horizontal walls 32 and the tongue portion 12.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A USB (Universal Serial Bus) plug connector comprising:

an insulative housing having a main portion and a tongue portion extending forwardly from the main portion, the tongue portion having an upper surface, a lower surface, a pair of lateral surfaces, and a frontal vertical surface, a pair of recesses being defined on both sides of each of the upper surface and the lower surface, an interspace being defined between each lateral surface of the tongue portion and the main portion;

a plurality of contacts retained in the insulative housing; and a metal shell assembled on the insulative housing, the metal shell comprising a front wall, a pair of horizontal walls bent backwardly from upper and lower edges of the front wall, and a pair of vertical walls bent backwardly from left and right ends of the front wall, each vertical wall comprising a base portion, a rigid beam extending backwardly from the base portion and inserted in the interspace of the insulative housing, and a pair of wing portions bent horizontally from upper and lower edges of the base portion and received in the recesses of the tongue portion.

2. The USB plug connector as claimed in claim 1, wherein the insulative housing has a dent at each lateral surface, and each vertical wall comprises a curved portion protruding forwardly from the base portion and inwardly to be received in the dent.

3. The USB plug connector as claimed in claim 1, wherein the metal shell comprises a pair of frame portions extending backwardly from the horizontal walls and securing with the main portion of the insulative housing.

4. The USB plug connector as claimed in claim 1, wherein the front wall, the horizontal walls, and the vertical walls are shaped as a cross when the metal shell is unfolded.

5. The USB plug connector as claimed in claim 4, wherein the front wall and the horizontal walls cooperatively define a first straight line, and the vertical walls and the front wall cooperatively define a second straight line perpendicular to the first straight line.

6. The USB plug connector as claimed in claim 1, wherein the insulative housing comprises an upper insulative plate and a lower insulative plate.

7. The USB plug connector as claimed in claim 6, wherein each of the upper insulative plate and the lower insulative plate comprises a plurality of blocks and a plurality of notches, the blocks of the upper insulative plate are retained in the notches of the lower insulative plate, and the notches of the upper insulative plate receive the blocks of the lower insulative plate for orientation.

8. The USB plug connector as claimed in claim 1, wherein the front wall of the metal shell has a height smaller than that of the tongue portion of the insulative housing along an upper and lower direction.

9. The USB plug connector as claimed in claim 8, wherein the tongue portion defines a plurality of slits retaining the contacts and a plurality of openings expose the contacts, and each horizontal wall defines a cutout suspending above the openings.

10. The USB plug connector as claimed in claim 1, wherein the wing portions are sandwiched between the horizontal walls and the tongue portion.

11. An electrical connector comprising:

a terminal assembly including a pair of opposite top and bottom terminal modules identical to each other and stacked with each other in a back-to-back manner in a vertical direction, each of said terminal modules including a plurality of contacts insert-molded within an insulator;

a metallic shell enclosing said terminal assembly and including:

a front wall covering a front surface of the terminal assembly;

a pair of opposite top and bottom horizontal walls respectively extending from opposite top and bottom edges of the front wall to cover horizontal surfaces of the corresponding insulators of said top and bottom terminal modules, respectively; and a pair of opposite frame portions respectively extending from side the corresponding top and bottom horizontal walls to engage the corresponding insulators in the vertical direction so as to secure the shell to the terminal assembly; wherein the frame portion extending from the top horizontal wall engages the insulator of the bottom terminal module in the vertical direction while the frame portion extending from the bottom horizontal wall engages the insulator of the top terminal module in the vertical direction, wherein said shell further includes a pair of vertical walls respectively extending rearwardly from two opposite lateral side edges of the front wall to cover side surfaces of the terminal module, wherein each of said vertical walls covers both corresponding portions of both said insulators, wherein each of said vertical walls includes opposite wings respectively engaging both said insulators.

12. The electrical connector as claimed in claim 11, wherein said pair of opposite vertical walls are opposite to each other in a transverse direction perpendicular to said vertical direction.

13. The electrical connector as claimed in claim 11, wherein said terminal assembly includes opposite dents in two opposite lateral sides, and each of said vertical walls forms a curved portion compliantly received within the corresponding dent.

14. The electrical connector as claimed in claim 11, wherein the frame portion engages the insulator of the bottom terminal module in the vertical direction further engages the insulator of the top terminal module in a transverse direction perpendicular to said vertical direction, and the frame portion engages the insulator of the top terminal module in the vertical direction further engages the insulator of the bottom terminal module in the transverse direction.

15. The electrical connector as claimed in claim 11, wherein each of the insulator has a recess and a protrusion to couple to those of the other, respectively, so as to have said pair of insulators engaged with each other in not only a transverse direction perpendicular to said vertical direction, but also a front-to-back direction perpendicular to both said vertical direction and said front-to-back direction.

* * * * *